US008896403B2

(12) United States Patent
Beyer et al.

(10) Patent No.: US 8,896,403 B2
(45) Date of Patent: Nov. 25, 2014

(54) INDUCTIVE ELECTRONIC MODULE AND USE THEREOF

(75) Inventors: Winfried Beyer, Chemnitz (DE); Stephan Gruber, Chemnitz (DE); Rene Franzky, Chemnitz (DE)

(73) Assignee: Exscitron GmbH, Chemnitz (DE)

( * ) Notice: Subject to any disclaimer, the term of this patent is extended or adjusted under 35 U.S.C. 154(b) by 0 days.

(21) Appl. No.: 13/502,920

(22) PCT Filed: Oct. 19, 2010

(86) PCT No.: PCT/EP2010/006355

§ 371 (c)(1),
(2), (4) Date: Apr. 19, 2012

(87) PCT Pub. No.: WO2011/047819

PCT Pub. Date: Apr. 28, 2011

(65) Prior Publication Data

US 2012/0206060 A1 Aug. 16, 2012

(30) Foreign Application Priority Data

Oct. 19, 2009 (DE) ..... 10 2009 049 939
Mar. 3, 2010 (DE) ..... 10 2010 010 235
Apr. 8, 2010 (DE) ..... 10 2010 014 281

(51) Int. Cl.
*H01F 38/20* (2006.01)

(52) U.S. Cl.
USPC ..... 336/173

(58) Field of Classification Search
USPC ..... 336/212, 170, 173, 180–184
See application file for complete search history.

(56) References Cited

U.S. PATENT DOCUMENTS

| | | | | |
|---|---|---|---|---|
| 3,940,662 | A | 2/1976 | Quirke | |
| 4,488,136 | A | 12/1984 | Hansen et al. | |
| 4,902,942 | A | 2/1990 | El-Hamamsy | |
| 6,380,836 | B2 | 4/2002 | Matsumoto et al. | |
| 6,490,180 | B2 | 12/2002 | Hiltunen et al. | |
| 6,980,077 | B1 | 12/2005 | Chandrasekaran et al. | |
| 7,042,323 | B2 * | 5/2006 | Joerg et al. | 336/184 |
| 7,872,561 | B2 * | 1/2011 | Matumoto | 336/200 |
| 7,956,491 | B2 | 6/2011 | Ochi et al. | |
| 8,315,073 | B2 * | 11/2012 | Matsumoto et al. | 363/21.06 |
| 2004/0119577 | A1 | 6/2004 | Weger | |
| 2005/0286270 | A1 | 12/2005 | Petkov et al. | |
| 2006/0255753 | A1 | 11/2006 | Sawada et al. | |
| 2009/0021924 | A1 | 1/2009 | Ogino et al. | |
| 2009/0230776 | A1 | 9/2009 | Ochi et al. | |

FOREIGN PATENT DOCUMENTS

| | | | |
|---|---|---|---|
| DE | 2510491 | A1 | 9/1975 |
| DE | 10260246 | A1 | 7/2004 |

(Continued)

OTHER PUBLICATIONS

Official action dated Jun. 12, 2012 for DE 10 2010 014 281.6.

*Primary Examiner* — Tuyen Nguyen
(74) *Attorney, Agent, or Firm* — Bachman & LaPointe, P.C.

(57) ABSTRACT

An inductive electronic module, comprising a core element having an inner limb (12; 29*a*) and at least two lateral limbs (14, 16; 33*a*, 35*a*; 37*a*, 39*a*) associated the inner limb on both sides, the core element being provided with windings (N1, N2, N3, N4) for forming a transformer. A first winding (N1, N2: 47, 49; 51, 53) is implemented as a series connection composed of two partial windings. A first partial winding is formed on a first lateral limb, and a second partial winding is formed on a second lateral limb.

11 Claims, 4 Drawing Sheets

(56) References Cited

FOREIGN PATENT DOCUMENTS

| | | | |
|---|---|---|---|
| DE | 102010010235 | A1 | 4/2011 |
| DE | 112009000632 | T5 | 4/2011 |
| EP | 1391900 | A1 | 2/2004 |
| JP | 61032506 | A | 2/1986 |

* cited by examiner

INDUCTIVE ELECTRONIC MODULE AND USE THEREOF

BACKGROUND OF THE INVENTION

The present invention relates to an inductive electronic module according to the preamble of the main claim as well to the use of such an electronic module; a generic module is known from the US 20050286270.

Transformers have been disclosed in the art where windings are formed on the limbs of an (approximately e-shaped) core element. A typical e-shape therefore forms an inner limb as well as two lateral limbs adjacent to the inner limb. Depending on the respectively provided transformer or transducer functionality these then have limb windings associated with them.

Furthermore it is known from the state of the art to implement transformers as so-called planar transformers by implementing the windings (typically provided stacked and suitably connected) in the form of conductor tracks on printed circuit boards. Such planar inductivities then cooperate with a core element formed for example of ferrite which engages in an breakthrough of a winding shaped as a "printed" coil on an associated circuit board. This approach in particular permits automated manufacture or manufacture in bulk.

In the context of complex circuit topologies which use a plurality of transformers or transducers, this, of necessity, leads to the need for a more efficient implementation and a reduction in the amount of components used, in particular in the context of the above mentioned planar technology. As an example for the use of such a technology in this context reference is made to the German patent application 10 2010 010 235 of the applicant, which, in view of the technological context described in there as an application for the present invention, shall be deemed to be part of the disclosure as belonging to the invention, and which discloses a control device for a plurality of LED strands (as consumers), which are acted upon by preferably the same predetermined split current. In essence this application provides for suitable transformers for each of these branches, wherein for a traditional implementation, in particular for a large number of branches or strands to be supplied with a predetermined split current in the manner described in there, a corresponding plurality of transformers is required. For a typical implementation in planar technology, these transformers have, of necessity, to be designed at great expense accompanied by a corresponding space requirement, resulting in the need to reduce the amount of components required for transformers in circuit topologies of this kind (and, of course, beyond it).

The use of an inactive electronic module for operating a plurality of LEDs arranged in the form of a strand is known moreover from the US 2006/0255753.

Accordingly it is a requirement of the invention to improve a generic inductive electronic module for implementing a transformer, in particular in planar technology, in such a way that a required component amount can be reduced for a plurality of transformers, the number of required core elements, in particular, can be reduced and, in the context of a planar technology, the required circuit board area can be reduced.

The requirement is met by the inductive electronic module having the characteristics of the main claim; advantageous further developments of the invention have been described in the sub-claims. Also, protection is claimed within the framework of the present invention for use of the inductive electronic module according to the main claim as well as the further developing sub-claims in respect of a current divider device, on which a current generated on the secondary side of a first transformer is split among at least two independently controlled consumer branches each comprising a transformer. Whilst the present invention is suited, in particular, to the current-driven control of LED series connections in their role of consumers, the present invention is nevertheless not restricted to these but rather is suitable for any application purposes where a plurality of transducers or transformers have to be implemented in an efficient manner using a minimum number of core elements. Within the framework of the present invention this applies, preferably, to implementations by means of planar technology, although in this context also the present invention is not restricted with respect to the range of applications.

According to the invention the inductive electronic module advantageously achieves a magnetic coupling between the first winding and the second winding with the result that each of these windings (each of which has a plurality of magnetically coupled, separately contactable conductors) is able to implement a transducer or transformer without the transformer implemented by the first winding (or a pair of conductors existing therein) magnetically influencing a transformer of the second winding.

According to the invention this is implemented in that the first winding is provided in the form of a series connection made up of two partial windings on two of the lateral limbs, in particular opposite each other in relation to the inner limb, i.e. in that it is implemented as a winding by means of two consecutively connected sections. The second winding, by contrast, is formed on the inner limb. With regard to the magnetic flows implemented by the windings according to the invention in the core element this can have the advantageous effect that a magnetic flow caused in the inner limb by the first winding (or the two partial windings on the lateral limbs) is cancelled or becomes zero in order to prevent the second winding formed on the inner limb from becoming magnetically influenced. As a result of the invention this advantageously leads to one and the same core element being able to form at least two transformers independent of one another, i.e. when the first winding implements a first transformer having a corresponding plurality of separately contactable conductors and the second winding (again having a plurality of conductors) implements a second transformer which is then, according to the invention, magnetically decoupled from the first transformer and is independent.

Whilst, as generally indicated above, it would be possible for this approach to the solution to be implemented discretely in principle on a core element body by means of suitable coils, it is nevertheless preferable in terms of the invention to use planar technology for implementing the invention. For this purpose the first and second windings are formed as an array of conductors on (at least) one circuit board, wherein the core elements then engage in breakthroughs or recesses in the circuit board in the area of the conductor windings. In order to achieve the desired inductivities the winding (with its details) may then be implemented as a multi-layer winding with suitable vertical contacting such as in the form of known multilayer circuit boards, or by additionally or alternatively using a plurality of single circuit boards suitably stacked and with through-connections according to the tracing of the conductors.

When using planar technology for implementing the present invention it is especially favourable and preferred to manufacture a transformer by arranging for at least two conductors of one of the windings to be traced in parallel and/or concentrically on a circuit board; in this way it is possible to predefine the winding structure exactly and so as to be easily reproducible but due to the areal layout the respectively desired magnetic coupling can also be easily configured thus allowing for a cost-effective manufacture in batches.

SUMMARY OF THE INVENTION

From the above described explanation of the principle according to the invention it becomes clear also that the transformers implemented by means of a common core element and magnetically decoupled from one another can, as regards their transformer characteristics (for example the transmission ratio) be implemented completely independently of one another.

Whilst in the simplest implementation case of the present invention one inner limb of the (common) core element is associated with two lateral limbs (on both sides), the present invention is not limited to this, rather the number of lateral limbs is to be understood as being "at least two", and it includes, for example, the typical implementation case where the inner limb is associated with two lateral limbs respectively on both sides so that three independent or decoupled transformers may be implemented on the same core element with the aid of these four lateral limbs, following the further-development principle that in order to implement n independent transformers, 2n−2 lateral limbs of the common core element are required; for reasons of achievable tolerances in terms of manufacture (and the displacement or asymmetries in the magnetic flow due to tolerance errors) a realistic upper limit is n=8, and typically n≤4 for less precise bulk manufacturing conditions.

The expert will know that in practicing the invention he has to wind the first and the second winding typically in the same direction in order to achieve the desired cancellation of the magnetic flow in the inner limb. Also a comparable number of turns of the respective conductors will normally have to be provided for (unless the magnetic flow is influenced in another way) in order to achieve the same magnitude of magnetic flow (which enables it to be cancelled).

In order to prevent the lateral limbs from reaching magnetic saturation when control of the two transformers is at its maximum, it is preferred according to the invention to design a magnetically effective cross-section of the inner limb in such a way that this occupies at least ⅔ of the cross-sectional area of one of the lateral limbs. Accordingly the magnetic cross-section of each lateral limb is, at its maximum, 1.5 times the cross-sectional area of the inner limb. When generalised for n transformers on the common core element the default for the ratio of cross-sectional area of one lateral limb ($A_A$) to the inner limb ($A_1$) then is $A_A:A_I=(2n-1):(2n-2)$.

According to the invention it is preferred and favourable from a manufacturing point of view, for an implementation in planar technology, to shape the core element as a flat body with one areal section (provided for cooperating with a circuit board), from which one-piece projections protrude, which then, in the manner described above as preferred embodiments, can engage in breakthroughs of the conductors for cooperating with windings provided on these.

In case the number of lateral limbs is an integral potency of 2, the advantageous further development of the invention is achieved when a number of transformers which (decoupled) can be provided on the common core element, corresponds to the number of lateral limbs associated with the inner limb. If for example four lateral limbs are associated with the inner limb it would be true to say that four transformers or transducers can be implemented insofar as the further development provides for an additional third winding. In this kind of symmetrical situation this would allow for a decoupling from the first and the second winding if the third winding extends across two lateral limbs provided on either side of the inner limb (wherein the third winding also may have a plurality of single contactable conductors for implementing a transducer or transformer). In this special case the following would be true with respect to the cross-sectional area ratio of inner limb to lateral limbs (again for the same magnetic control of all transformers): $A_A:A_I=(2n-1):n$, wherein $A_A$ corresponds to the cross-sectional area of one lateral limb and $A_I$ to the cross-sectional area of the inner limb and n is the number of transformers on the common core element if n is an integral potency of two.

For this special further development of the invention also (in the same way as for the above described embodiments) it is true to say that at least one of the transformers may comprise galvanically separated windings (for example for disconnecting from the mains) or that the inner limb may have an air gap (for a throttle or a similar device located in it). Also, in principle, the transformers may be designed as resonance, locking of flow converter transformers to suit any given topologies or purposes.

The present invention is particularly relevant in the context of circuit arrangements in which a plurality of transformers is provided since the advantages of the invention would be particularly pronounced in this case. Accordingly in terms of the present invention a use for implementing a current divider device is claimed as a circuit for driving a plurality of LED strands or similar consumers, as disclosed in the DE 10 2010 010 235 and deemed to be included in the present disclosure as belonging to the present invention (and claimed as a further development of the invention). Specifically, approximately the plurality of transformers required for driving four consumer strands or branches by means of a respective current driver, is advantageously claimed as being suitable for use by means of the inductive electronic module of the present invention, preferably by means of just one electronic core element and for implementing up to four separately decoupled transformers.

In conclusion the present invention makes it possible, in a surprisingly simple and efficient way, to significantly implement the component amount for circuit realisations using a plurality of transformers, in particular due to the possibility offered by the invention to implement a plurality of (magnetically independent and decoupled) transformers by means of a common magnetic core element, wherein in particular planar technology promises considerable manufacturing advantages for the implementation of windings as printed conductor tracks.

BRIEF DESCRIPTION OF THE DRAWINGS

Further advantages, features and details of the invention can be gained from the following description of preferred embodiments and the accompanying drawings, in which.

DETAILED DESCRIPTION

Figure 1:
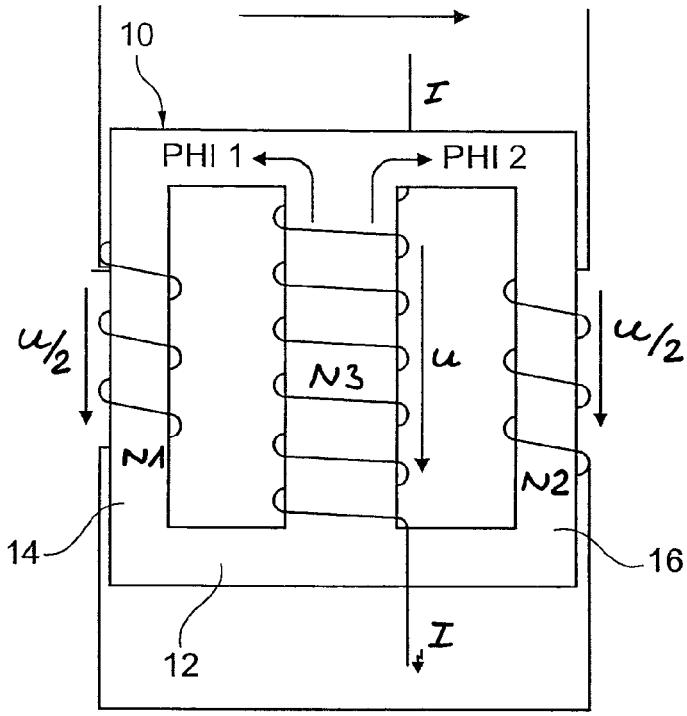
FIG. 1 shows a schematic illustration of a core element with an inner limb and two lateral limbs for illustrating the basic principle of the present invention.

FIG. 1 illustrates the basic principle of the present invention, schematically showing two windings N1/N2 on the one hand and one winding N3, on the other, which are provided on a core element 10 comprising an inner limb 12 and two lateral limbs 14, 16 (adjacent to each other on either side of the inner limb 12). In detail, the first winding is comprised of a series connection consisting of two partial windings N1 and N2, which are provided in the manner shown on the lateral limbs 14, 16 and in the embodiment shown are designed symmetrically with respect to a winding number (and an effective magnetic cross-section of the respective limbs 14, 16). The second winding N3 is formed on the inner limb 12.

According to the invention it is advantageous that such an arrangement permits a magnetic decoupling of the respective windings (which in addition, as will be described in detail hereunder, may form transformers or transducers among each other in conjunction with a plurality of independently contactable conductors). Thus the partial winding N1 when energised generates a magnetic flow (not shown in detail in the figure) in core 10, the magnitude of which corresponds to the magnetic flow generated by partial winding N2 and flows in the same direction. With regard to the inner limb 12 this flows is neutral for in the inner limb respective magnetic flows generated by the partial windings would neutralise or cancel each other out (because they flow against each other).

In addition the second winding N3 generates a magnetic flow in the core which is evenly split among the lateral limbs 14, 16, as shown by the flow arrows PHI1 or PHI2. These magnetic flows of the second winding N3 then induce currents or voltages (U/2 in FIG. 1) in the partial windings N1, N2, which, provided the magnetic path length from the inner limb 12 into both lateral limbs 14, 16 is the same, are neutralised and cancelled. The result is that the first winding (N1 and N2) has no magnetic influence on the second winding N3 and vice versa, with the advantageous effect that the same core unit 10, with the shown arrangement of inner limb 12 and (at least) two lateral limbs (here outer limbs), can receive two independently operable windings (or winding systems if these are perceived as an arrangement of a plurality of conductors) which are magnetically decoupled.

Figure 2:
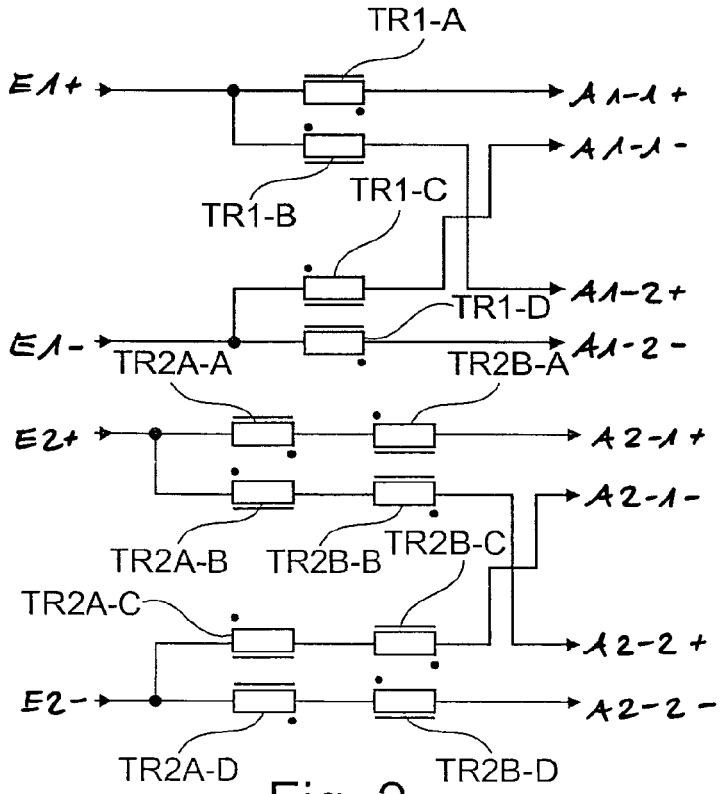
FIG. 2 shows a circuit diagram of two independent transformers each comprising four conductors, which can be realised using the basic principle of FIG. 1.

The circuit diagram of FIG. 2 illustrates a translation of this merely schematically drawn principle in practice. The upper half of the circuit diagram in FIG. 2 shows a transformer with two coil pairs (four individual coils in total), TR1-A to TR1-D. In the lower area FIG. 2 shows two further partial transformers TR2A and TR2B which together again form two coil pairs, respectively.

Due to the fact that the four individual coils TR1-A to TR1-D, wound together as individual conductors, make up winding N3 on the inner limb 12 (or on a corresponding planar equivalent), the four individual coils TR2A-A to TR2A-D as respectively individual conductors make up the partial winding N1 on the lateral limb 14 and the four individual coils TR2B-A to TR2B-D are implemented as conductors of the second partial winding N2, a multiple transformer arrangement has been created, where all coils of transformer TR1 are magnetically decoupled from transformers TR2 and may be operated completely independently from each other, even if they are arranged on a common core element.

Figure 3:
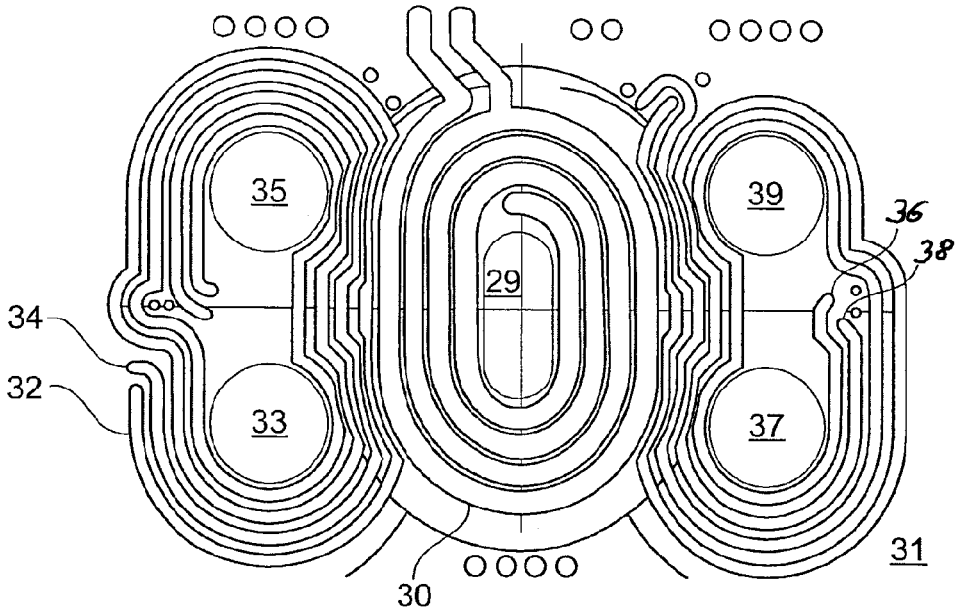
FIG. 3 shows a conductor layout of a conductor surface for implementing the circuit topology of FIG. 2 (in a stacked arrangement not shown)
Figure 6:
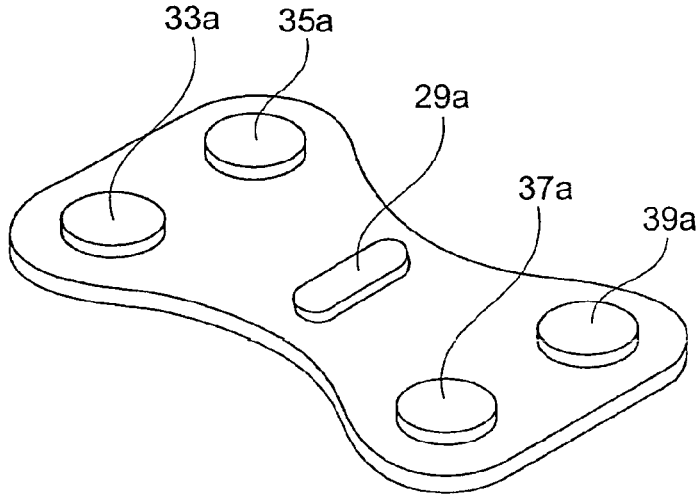
FIG. 6 shows a perspective view of a one-piece core element (core half), of which one pair is used to realise the embodiments of FIGS. 3 to 5.

FIG. 3 illustrates the possibility, using the example of a conductor track layout, of implementing such a circuit arrangement with a common core in a planar manner (FIG. 6) by means of conductor tracks. The layout in FIG. 3 shows a conductor track layer (for example as part of a multi-layer or a stacked arrangement of several circuit boards), which on both sides of a central coil 30 comprises a first coil pair 32, 34 at one end, a second coil pair 36, 38 at the other end, these being respectively implemented as conductor track structures on a circuit board 31. Additionally this comprises breakthroughs at the positions 29 as well as 33, 35 and 37, 39 respectively, into which core elements (one if which is shown in FIG. 6) can be inserted in such a way that projections 29*a*, 33*a*, 35*a* and 27*a*, 39*a* respectively of the plate-shaped core units formed in one piece from ferrite material—one as shown from below and the other turned from above with respective breakthroughs (here circular or oval)—can cooperate with the respective breakthroughs and magnetically offer the desired core functionality for the respective windings.

In the embodiment shown the central coil 30 (in cooperation with the core section 29*a*) merely represents a coil of the quadruple transformer TR1 consisting of four coils (windings) as in FIG. 2; further coils would then be realised by suitably stacked and separately contacted conductor track layers.

Similarly the dual conductor track coil 32, 34 merely represents a pair (for example TR2A-A and TR2A-B) of the first transformer formed on the lateral limb, wherein here the core sections 33*a* and 35*a* (in cooperation with the respective conductor track breakthroughs 33, 35) are deemed to be the common core section, and a corresponding superimposed conductor track layer, if separately contacted, may form either the further coils or coil pairs of this transformer, or, since the coils of the parallel conductor track pair 32, 34 are traced from the outside to the inside, it may trace the tracks of the same coils back to outside.

This description applies analogously to the opposite lateral limb comprising the coil pair 36, 38 in cooperation with the associated core section 37*a* or 39*a* (shown here as the common limb).

In conclusion this embodiment illustrates, how a plurality of independent transformers may be implemented using a small amount of components and thus facilitating a cost-effective manufacture.

Figure 4:
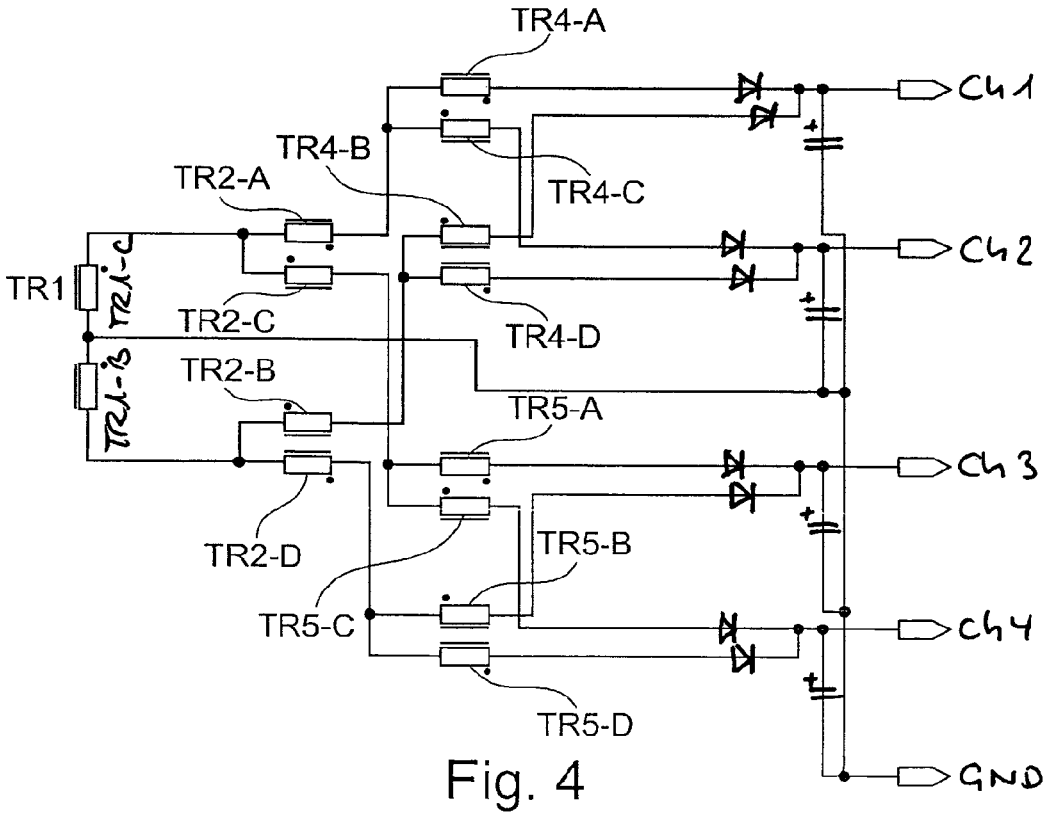
FIG. 4 shows a circuit diagram of a circuit arrangement with three or four transformers in the further development of the basic principle of FIGS. 1 to 3 on four lateral limbs.
Figure 5:
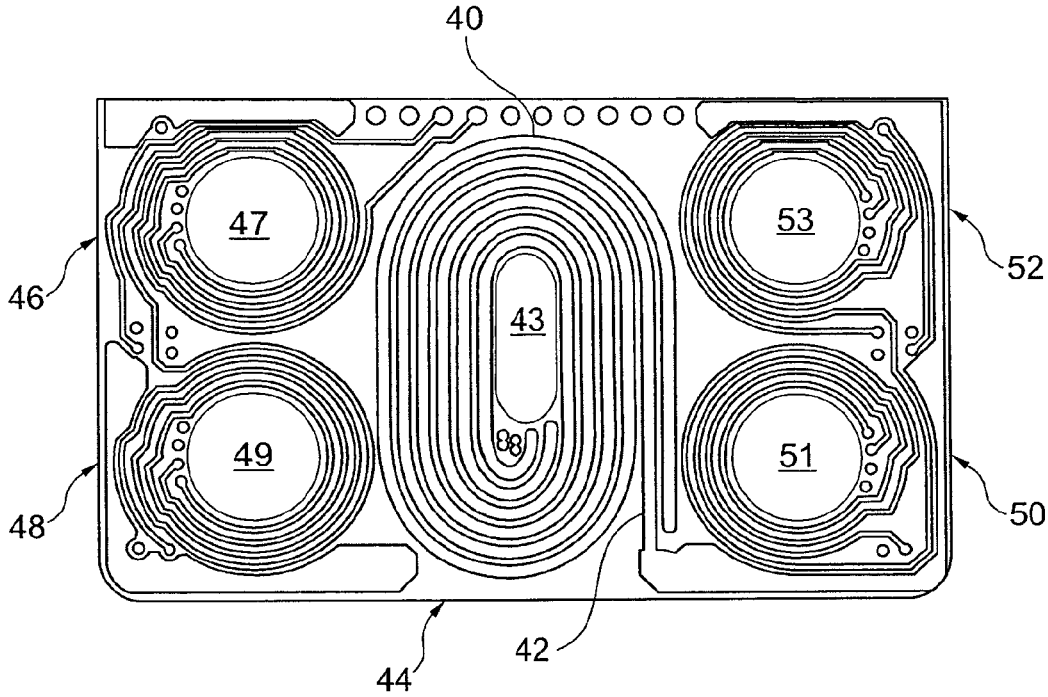
FIG. 5 shows an associated conductor layout of a corresponding circuit board (as part of a stacked arrangement)

FIGS. 4 to 6 show, how integration can be increased further. Although the same one-piece core element as in FIG. 6 is used, this now serves to receive three independently decoupled transformers.

This type of application is illustrated in the circuit diagram shown in FIG. 4, which, in other respects, corresponds to FIG. 4 of German patent application 10 2010 010 235 of the applicant and, in view of the associated description in there, is deemed to be included in the present disclosure as belonging to the invention. Specifically, this is a current divider circuit which, on the secondary side of a main transformer TR1 (with central tap) provides for a total of three transformers TR2, TR4 and TR5, each comprising four individual coils arranged in pairs. These three divider transformers TR2, TR4 and TR5 are implemented using a four-layer arrangement of the planar layout of FIG. 5 as will now be described in detail. FIG. 5 initially shows an oval-shaped conductor track and two windings 40 and 42 comprising two parallel conductor tracks formed as separate coils for implementing a part of the first transformer TR2; in this example printed coil conductors 40, 42 could form the transducer pair TR2-A, TR2-C in FIG. 4. These are, again with an oval central breakthrough 43 in the associated circuit board 44, designed for cooperating with projection 29*a* of the core element in FIG. 6 and are traced to a contact end in the inner area, from where there exists a through-connection (not shown) to a superimposed or underlying conductor track layer for the pair of conductor tracks 40, 42, whereby these are then traced back to a connectable outside area. Correspondingly a stacked arrangement of four layers of the layout shown in FIG. 5 for the conductor track coils 40, 42 would represent the four individual coils of transformer TR2 with the common core section 29*a*.

Four further ring-shaped printed conductor track dual coils 46, 48, 50, 52 (each with an inside breakthrough 47, 49, 51, 53) now represent transformers TR4 (for example by means of the dual coils 46, 48) or TR5 (50 and 52). In other words, superimposed and further layers (not shown) of the layout shown in FIG. 5 make it possible on the one hand, to trace respective printed coil pairs back to the outside for external contacting by means of vertical through-connections not shown, and on the other, further superimposed conductor track layers of the shown planar arrangement represent the additional further coupled individual coils of the respective transformers.

Thus, as shown in FIGS. 4 to 6, a device is implemented which by means of core elements with one inner and four outer limbs realises a total of three magnetically decoupled and independent transformers (with respectively four individual coils or conductors) following the teaching described in the beginning that for n (here three) transformers on a common core this must comprise 2n−2 (here four) outer or lateral limbs adjacent the inner limb.

Figure 7:
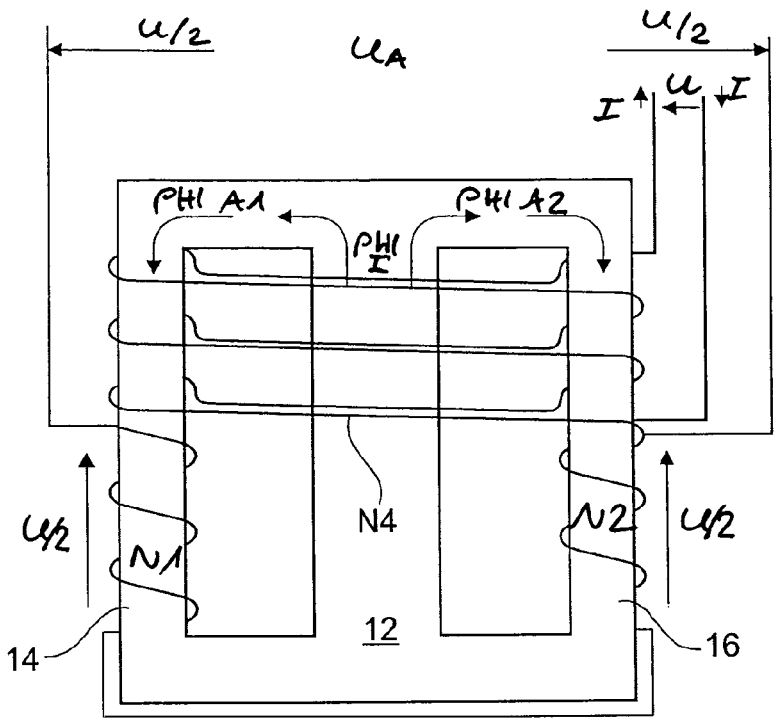
FIG. 7 a schematic illustration analogous to FIG. 1 for illustrating the special case of increasing the number of transformers independently operable on a transformer core, where the number of lateral limbs is equal to the integral potency of 2.
Figure 8:
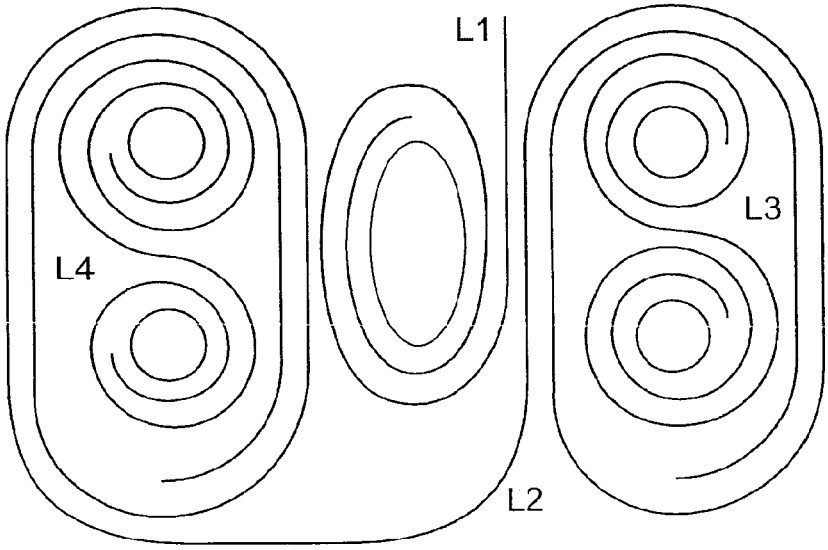
FIG. 8 shows an illustration of the principle for arranging the four transformers on the core of FIG. 6.

FIGS. 7 and 8 show for the present special case in which the number of lateral limbs (here four) is an integral potency of 2, how even a number of (decoupled) transformers can be provided on one core element which corresponds to the number of lateral limbs as such (i.e. four again).

This is initially illustrated, analogously to the drawing in FIG. 1, in the principal drawing of FIG. 7 (wherein the reference symbols chosen for FIG. 1 apply). This arrangement contains a further coil, i.e. N4, which in the shown manner, extends past the inner limb 12 and across both lateral limbs 14, 16. The additional winding N4 when energised keeps neutral also across the further windings N1/N2 and N3 (not shown in FIG. 7 for reasons of clarity) and leads to induced voltages or currents which are neutralised or cancelled thereby realising four independent transformers in the shown manner.

The schematic drawing of FIG. 8 illustrates a concordance between these windings wherein if implementation is effected by means of a corresponding stacked arrangement of a plurality of printed conductor track structures (analogously to FIG. 5 where FIG. 3 would represent an additional layer), this technique could be realised in planar technology.

As shown in FIG. 8 the (partial) windings N1, N2, when duplicated on the lateral limbs, would be provided (L3 and L4) adjacent to the inner limb of the common core (FIG. 6). Winding N4 would be realised by the conductor track pattern (L2) extending across all lateral limbs, and winding N3 would be wound (L1) around the inner area of the core element, insofar corresponding to the inner limb.

When applied to the circuit diagram of FIG. 4 this would mean that in addition to the already described three independently implemented transformers TR2, TR4 and TR5 the main transformer TR1 (with one winding on the primary side and two windings on the secondary side) could also be implemented, wherein the central winding L1 of FIG. 8 would then represent the primary transformer TR1, L3 and L4 provided on the lateral limbs would represent transformers TR4 and TR5 and the large outer winding L2 would represent transformer TR2. When translated into practice a stacked arrangement comprising four layers as per FIG. 5 would then be superimposed by four layers of the stacked arrangement of FIG. 3 (for example, the windings 32, 34 of FIG. 3, connected to 36, 38, could form TR2-A and TR2-C, winding 30 could be the primary winding of TR1 not shown in FIG. 4, windings 40, 42 in FIG. 5 could form the secondary side of TR1, the coil pairs 46, 48 form TR4-A and TR-C, and 50, 52 form TR5-A and TR5-C).

In conclusion the present invention makes it possible, for an appropriate design of a structure consisting of inner and lateral limbs of a common core element, to equip the core element with a plurality of magnetically decoupled transformers which is particularly favourable for implementations in planar technology but not limited thereto. Especially in view of applications involving a plurality of transformers or transducers the required amount of components can be drastically reduced, leading to a corresponding impact upon manufacturing and production efficiencies.

The invention claimed is:

1. An inductive electronic module comprising:

a core element having an inner limb (12; 29*a*) and at least two lateral limbs (14, 16; 33*a*, 35*a*; 37*a*, 39*a*) associated with the inner limb on both sides, said core element being provided with windings (N1, N2, N3, N4) for forming a transformer, wherein a first winding (N1, N2; 47, 49; 51, 53) is implemented as a series connection composed of two partial windings, of which the first partial winding is formed on a first lateral limb and a second partial winding is formed on a second lateral limb, the first and the second partial windings have a number of turns and a direction of turn which are designed such that a resulting magnetic flow of the first winding is cancelled in the inner limb, and in particular is zero, and a second winding (N3; 40, 42) is formed on the inner limb, wherein, in order to implement a transformer that is magnetically decoupled from the other windings respectively, the first and/or the second windings comprise at least two conductors which can be contacted separately from one another, characterised by a fourth winding (N4) which extends across two lateral limbs provided on both sides of the inner limb.

2. Module according to claim 1, wherein the first and the second winding are formed as conductor tracks on at least one circuit board (31; 44) comprising breakthroughs (33, 35, 37, 39; 47, 49, 51, 53) and/or recesses for the sections of the core element implementing the limbs.

3. Module according to claim 2, wherein at least two conductors of the first and/or the second winding are traced together, at least in sections, extending in parallel and/or concentrically, on a common circuit board for achieving a magnetic coupling.

4. Module according to claim 3, wherein the circuit board is designed as a multilayer structure for a plurality of conductor track layers of the windings and/or is part of a stacked arrangement of a plurality of circuit boards.

5. Module according to claim 1, wherein, in order to implement n respectively magnetically independent and/or decoupled transformers, 2n−2 lateral limbs of the common core element are associated with the inner limb, wherein n is a natural number ≥2 and ≤12.

6. Module according to claim 1, wherein the core element is designed in such a way that a ratio of the magnetically effective cross-sectional area of one of the lateral limbs relative to the cross-sectional area of the inner limb for n lateral limbs is at least (2n−1):(2n−2).

7. Module according to claim 1, wherein a transformer implemented on the inner limb with at least two conductors has a first dividing ratio, a transformer implemented on two of the lateral limbs with at least two conductors has a second dividing ratio and the first and second dividing ratios are established independently of one another and are different from one another.

8. Module according to claim 1, wherein the core element comprises a planar-shaped areal section for cooperating with a circuit board, from which areal section at least one moulded-on one-piece projection (33*a*, 35*a*, 37*a*, 39*a*, 29*a*) extends.

9. Module according to claim 1, wherein the fourth winding (N4) comprises a plurality of individually contactable conductors.

10. Module according to claim 1, wherein the fourth winding is not wound around the inner limb.

11. Module according to claim 1, wherein the transformer is a power transformer.

* * * * *